US006341895B1

(12) United States Patent
Tani

(10) Patent No.: US 6,341,895 B1
(45) Date of Patent: Jan. 29, 2002

(54) COLLAPSIBLE CONTAINER WITH CORRUGATED EDGE STRUCTURE

(76) Inventor: Kanari Tani, 70, Minamigaoka 4-chome, Ohnojo-shi, Fukuoka (JP)

( * ) Notice: Subject to any disclaimer, the term of this patent is extended or adjusted under 35 U.S.C. 154(b) by 0 days.

(21) Appl. No.: 09/461,457

(22) Filed: Dec. 14, 1999

(30) Foreign Application Priority Data

Dec. 16, 1998 (JP) ..... 10-357361

(51) Int. Cl.[7] ..... B65D 30/08
(52) U.S. Cl. ..... 383/116; 383/104; 383/107
(58) Field of Search ..... 383/104, 107, 383/116, 906, 80, 201, 202

(56) References Cited

U.S. PATENT DOCUMENTS 4,041,851 A * 8/1977 Jentsch ..... 383/107 X
4,058,632 A 11/1977 Evans et al.
4,353,497 A * 10/1982 Bustin ..... 383/104
4,964,515 A * 10/1990 Heyden ..... 383/107 X
5,328,439 A * 7/1994 Goldberg ..... 493/467
5,634,572 A 6/1997 Lane, Jr. et al.
5,660,477 A * 8/1997 Ichikawa ..... 383/906 X
5,944,251 A * 8/1999 LaFleur ..... 383/104 X

FOREIGN PATENT DOCUMENTS

DE 1 062 623 * 7/1959 ..... 383/107
DE 39 26 728 * 2/1991 ..... 383/104
DE 29602292 10/1997
WO WO80/00332 3/1980

* cited by examiner

*Primary Examiner*—Jes F. Pascua
(74) *Attorney, Agent, or Firm*—Jordan and Hamburg LLP

(57) ABSTRACT

The collapsible container is formed by joining plural sheets of laminated films by thermal fusion or otherwise, and the collapsible container is provided with a corrugated edge structure at least in part at the edge of the outer peripheral portion at which the plural sheets of laminated films are joined together. The provision of the corrugated edge structure at the edge of the outer peripheral edge portion of the container can prevent the hand holding the container from being cut and hurt even if the hand would slip along the outer peripheral portion thereof.

6 Claims, 5 Drawing Sheets

COLLAPSIBLE CONTAINER WITH CORRUGATED EDGE STRUCTURE

FIELD OF THE INVENTION

The present invention relates to a collapsible container with a corrugated edge structure for use for example in pushing or sucking the contents out. More particularly, the present invention relates to such a collapsible container having such a corrugated edge structure that can prevent the hand holding the container from slipping along a fringed edge portion of the collapsible container upon pushing or sucking the contents out, so that injury of the hand can be prevented.

BACKGROUND OF THE INVENTION

There have been used various types of collapsible containers for use in pushing or sucking out the contents, such as water, shampoos, rinses and any other fluid material, which are composed of plural sheets of synthetic resin films, paper and/or aluminum foils laminated by thermal fusion or the like.

Conventional collapsible containers of a type as shown in FIG. 9 for example are composed of a first film member, a second film member, and a bottom film member as a bottom portion thereof, each film member being made of a laminated film, and each film member being joined at its peripheral outer edge portion by thermal fusion or the like. Conventional collapsible containers of a type as shown in FIG. 10 for example are composed of a first film member, a second film member, and first and second side film members each being joined with side edge portions of the respective first and second film members by thermal fusion or the like. In either case, however, the resulting collapsible containers are hard at their joined edge portions, and in many cases the joined edge portions of the container are cut straight at a sharp angle, as if a razor blade, so that the hand holding the container becomes very likely to be cut upon slippage along the sharply cut edge of the container.

In particular, when the collapsible container is to be used in a wet location such as a kitchen or bath room or in a wet condition or when the hand holding the container is wet, the hand may also become very slippery and the hand may slip along the sharp peripheral edges thereof and be cut thereby.

Moreover, when the collapsible container is often stored in a cold or freeze place for use as a container for drinking water or liquid material or sucking the contents out, the container may become wet due to water drops present on the surface thereof so that the hand may also become so slippery that it may be cut and hurt upon slippage along the sharp edge of the joined edge portions thereof.

In conventional cases as described above, the joined edge portion of the collapsible container at which the laminated film sheets are joined together by means of thermal fusion or any other joining process becomes so hard that the edge of the joined edge portion may sometimes become very sharp as if a razor blade. The hand holding the container may often be cut at the sharp edge of the joined edge portion when the hand would slip along the edge thereof due to the container being wet or for other reasons.

DISCLOSURE OF THE INVENTION

Therefore, the present invention has the object to provide a collapsible container with a corrugated edge structure at its edge portion that is less slippery upon pressing the container in order to squeeze water or any other contents out from the inside thereof by pressing it.

In order to achieve the object, the present invention provides a collapsible container having a corrugated edge structure at the edge of a peripheral edge portion thereof, the collapsible container being formed by joining laminated films at their peripheral edge portions by means of thermal fusion or any other means for joining laminated films with each other.

The present invention further provides a collapsible container having its peripheral edge portion joined together by means of thermal fusion or otherwise so as to provide a margin portion outside the joined edge portion, the margin portion being preferably formed with a corrugated fringe at its edge portion.

More particularly, the collapsible container in a mode of the present invention comprises a first film member and a second film member, the first and second film members being each made of a laminated film composed of plural sheets of films and each being substantially equal in size and shape to each other and being joined together at their peripheral side edge portions by means of thermal fusion or any other appropriate means to form a collapsible container with a corrugated edge structure at the side edge portions thereof, which can be filled with water or other fluid contents. The resulting collapsible container is provided at an appropriate location of the joined edge portions with a corrugated edge structure that is arranged so as to prevent the hand holding the container from being cut and hurt at the edge of the joined edge portion thereof even if the hand would slip along the edge of the container.

Further, the collapsible container according to another mode of the present invention has the first and second film members joined together with each other at their top and bottom edge portions and further at their side edge portions with the side film members in substantially the same manner as above to form a collapsible container with a corrugated edge structure at the side edge portions thereof, which can be filled with water or other fluid contents.

Moreover, the collapsible container according to another mode of the present invention has the first and second film members joined together with each other at their top and side edge portions and further at their bottom edge portion with the bottom film members in substantially the same manner as above to form a collapsible container with a corrugated edge structure at the side edge portions thereof, which can be filled with water or other fluid contents.

In a further mode of the present invention, the collapsible container having substantially the same configuration as the collapsible container in the above mode thereof may further be provided with a non-joined fringe portion outside the joined edge portion thereof. In this mode of the collapsible container, the non-joined fringe portion further is preferably provided with a corrugated structure at least partially at its edge in such a manner that the hand holding the container would not be cut and hurt at the edge of the non-joined fringe portion thereof, even if the hand would slip along the fringe portion thereof. In this mode of the collapsible container, however, such a corrugated structure is not required to be formed at the edge of the non-joined fringe portion outside the joined edge portion if the non-joined fringe portion would be soft enough to fail to cut and hurt the hand holding the container even if the hand would slip along the fringe portion thereof.

It is to be noted herein that the "corrugated" edge structure is not restricted to any specific edge structure and that the term "corrugated" and related terms are intended herein to mean any edge structure that can prevent the hand holding the container from being cut by the sharp edge of the container even if the hand would slip along the edge of the collapsible container.

Other objects, features and advantages of the present invention will become apparent in the description of this specification that follows, with reference to the accompanying drawings.

BRIEF DESCRIPTION OF THE ACCOMPANYING DRAWINGS

FIG. 6(*b*) shows an edge structure in corrugated form; and FIG. 6(*c*) shows an edge structure in the form of a cycloid.

DESCRIPTION OF THE PREFERRED EMBODIMENTS

Figure 1:
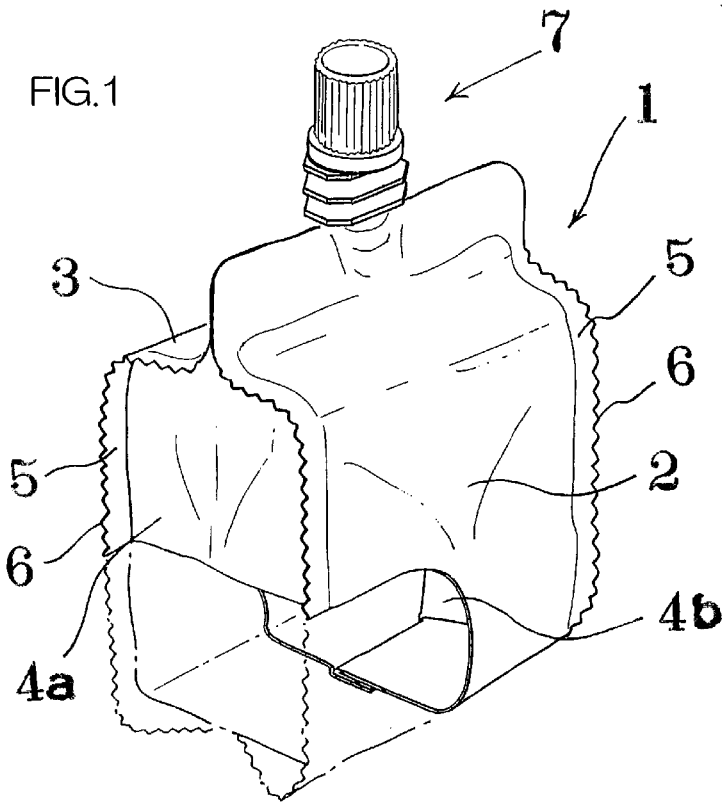
FIG. 1 is a perspective view showing a collapsible container according to a first embodiment of the present invention.

The collapsible container according to the present invention may be made of a synthetic plastic film that in turn is composed of laminating plural sheets of synthetic plastic films into a laminated film. The collapsible container may comprise a first film member and a second film member, the first and second film members being composed each of a laminated film and bonded to each other at their peripheral edge portions by means of thermal fusion or any other appropriate joining process so as to form a bag or otherwise that can be filled with water or any other fluid contents.

More particularly, the collapsible container in a mode according to the first embodiment of the present invention may be composed of the first and second film members as well as the first and second side film members, the first and second film members being joined together with each other at their top and bottom peripheral edge portions by means of thermal fusion or any other appropriate joining process, with leaving a portion open at an appropriate location of the top peripheral edge portion thereof in order to allow water or any other fluid contents to be filled in the container therethrough or to be pulled and sucked up therefrom, and the first and second side film members being joined together with the side edge portions of the first and second film members by means of thermal fusion or any other appropriate joining process, thereby forming a bag with an opening on top thereof which can be filled with water or any other fluid material. A corrugated edge structure is provided in part or in whole at an appropriate location along the edge of the joined peripheral edge portion of the collapsible container.

The collapsible container in a mode of the second embodiment according to the present invention may be comprised of the first and second film members and the bottom film member, the first and second film members being likewise joined together with each other at their peripheral top and side edge portions with a portion left open at the top peripheral edge portion and with their bottom edge portions non-joined with each other, and the bottom film member being joined with the non-joined bottom edge portions of the first and second film members by means of thermal fusion or any other appropriate joining process to form a collapsible container. A corrugated edge structure is provided in part or in whole at an appropriate location along the edge of the joined peripheral edge portion of the collapsible container.

The collapsible container in a mode of the third embodiment of the present invention may be configured in such a manner that a non-joined margin portion is formed at the fringe portion outside the joined side edge portion at which the first and second film members are joined together with each other by means of thermal fusion or any other appropriate process or at which the first and second film members are joined together with the corresponding first and second side film members in the like manner.

The collapsible container in another mode of the third embodiment of the present invention may be provided with a corrugated edge structure in part or in whole at an appropriate location along the edge of the non-joined margin portion of the collapsible container.

Although the present invention is described with reference to the collapsible containers according to the first, second and third embodiments as described above, it can be clearly understood that the present invention is not interpreted in any respect as being restricted to those specific containers in accordance with the above embodiments and as encompassing every appropriate modifications and variations as long as those modifications and variations can be used so as to fit the purposes of the container according to the present invention.

It can be noted herein that the manner of joining the film members is not restricted to a particular joining process and that any appropriate process can be applied to the manner of forming the collapsible container as long as it is suitable for joining the laminated films for use in manufacturing the collapsible container according to the present invention and it is carried out in conditions selected appropriately so as to meet the material of the laminated films and so on. Thermal fusion is preferred under conditions as selected so as to comply with the process for manufacturing the collapsible container according to the present invention.

In an aspect of the present invention, the collapsible container is provided with a corrugated edge structure at the edge of the joined edge portion of the outer side peripheral portion thereof in such a manner that the edge of the joined edge portion is not so sharp as conventional ones and therefore the hand holding the container is not caused to be cut even if the hand would slip along the joined edge portion thereof. In another aspect of the present invention, the collapsible container is provided with a non-joined margin portion outside the joined edge portion of the outer side peripheral portion thereof or further with a corrugated edge structure at the edge of the non-joined margin portion, in such a manner that the edge of the non-joined margin portion is not so sharp as conventional ones and thus the hand holding the container is very unlikely to slip along the edge portion and to be cut by the edge thereof, even if the container or the hand holding the container would be in a wet condition.

The method for forming the such corrugated edge structure at the outer periphery of the container in accordance with the present invention is not restricted to a particular method and any appropriate method can be applied to the present invention as long as it can meet the requirements by the method according to the present invention. Further, the such corrugated edge structure may be formed in an appropriate step of manufacturing the collapsible container, and it may be formed, for example, prior to or subsequent to the manufacture of the collapsible container. More specifically, in an example, the laminated film member may be cut in a size and shape equal to the first and second film members and the outer edge of each of the first and second film members is shaped with a corrugated form or it may be cut in a given size and shape with a cutter having a blade pattern corresponding to the given corrugated edge structure. Thereafter, the first and second film members are joined together to form a collapsible container. In another example, two sheets of the laminated film members may be joined so as to form a collapsible container and cut into a shape of the container and the outer edge of the joined edge portion is then shaped with a corrugated form, or the laminated film sheet joined in the shape of a container is cut into the shape of a collapsible container with a cutter having a blade pattern corresponding to the given corrugated edge structure. In a further example, two sheets of the laminated film members may be joined so as to form a collapsible container and cut into a shape of the container, preferably with a cutter having a blade pattern that complies with the given corrugated edge structure, while leaving a margin portion outside the joined edge portion thereof so as to provide a non-joined fringe portion thereof. The edge of the non-joined fringe portion of the container may be provided with a corrugated edge structure, as needed, so as to meet requirements based on the kind of material for the laminated film member.

The laminated film to be used for the present invention is not restricted to a particular type of film, and any kind of film or otherwise may be used for the present invention as long as it meets the objects and features of the present invention. The laminated film for use in accordance with the present invention may preferably comprise a multiple-layer film, such as a three-layer film, made of a synthetic resin, each film layer being joined together by means of thermal fusion or any other appropriate process. The first layer may be preferably composed of a polyethylene or polypropylene layer and constitute the outermost layer of the container. The second layer may be preferably composed of a two-ply film member, one being a polyethylene terephthalate or an oriented nylon layer and the other being an aluminum foil, oriented nylon or paper or a laminated layer of two kinds. The third layer may be preferably composed of a polyethylene or polypropylene resin layer and constitute the innermost layer of the container. These layers are laminated integrally with the second layer interposed between the first and second layers so as to provide a given degree of rigidity. Upon forming the collapsible container of the present invention, the first and second film members are joined together with each other at their outer peripheries so as to allow the third layers of the first and second film members to face each other to form a collapsible container. When the collapsible container is used for filling water or other liquid contents therein, the third layer constituting the innermost layer may be preferably made of material, for instance, that can resist to water or other fluid contents and that can withstand cooling or freezing temperature, depending upon the usage of the container.

When the first and second film members are made of the laminated film having the specific configuration as described above, the film members are provided with a sufficient degree of rigidity so that, when the resulting collapsible container can be filled with an adequate amount of water or other contents, the collapsible container can be placed in a stand-alone state with its bottom portion expanded to the sufficiently wide width. Therefore, when the container is filled with water or other fluid contents, there is no risk that the container falls down and the fluid contents filled therein are leaked from the opening even if it would be placed with the lid left open.

Now, a description will be made of the specific configuration of the collapsible container according to each of the embodiments of the present invention with reference to the accompanying drawings.

FIG. 1 shows the collapsible container according to the first embodiment of the present invention. As shown in FIG. 1, a collapsible container 1 comprises, for example, a first film member 2 constituting a front face of the container, a second film member 3 constituting a back face thereof, and a first side film member 4*a* and a second side film member 4*b*, each of the first and second side film members 4*a* and 4*b* constituting side portions of the container. Each of the film members is made of a laminated film having the composition as will be described below in more detail.

In this embodiment, the first film member 2 and the second film member 3 are joined together with each other at their top and bottom portions by means of thermal fusion or otherwise with each a portion on top left non-joined and open for an opening 7. The first and second film members 2 and 3 are joined with the first and second side film members 4*a* and 4*b* at their outer peripheral portions by means of thermal fusion or otherwise, forming a joined peripheral edge portion 5 at which the first and second film members are bonded to the first and second side film members, thereby forming a collapsible container.

Figure 8:
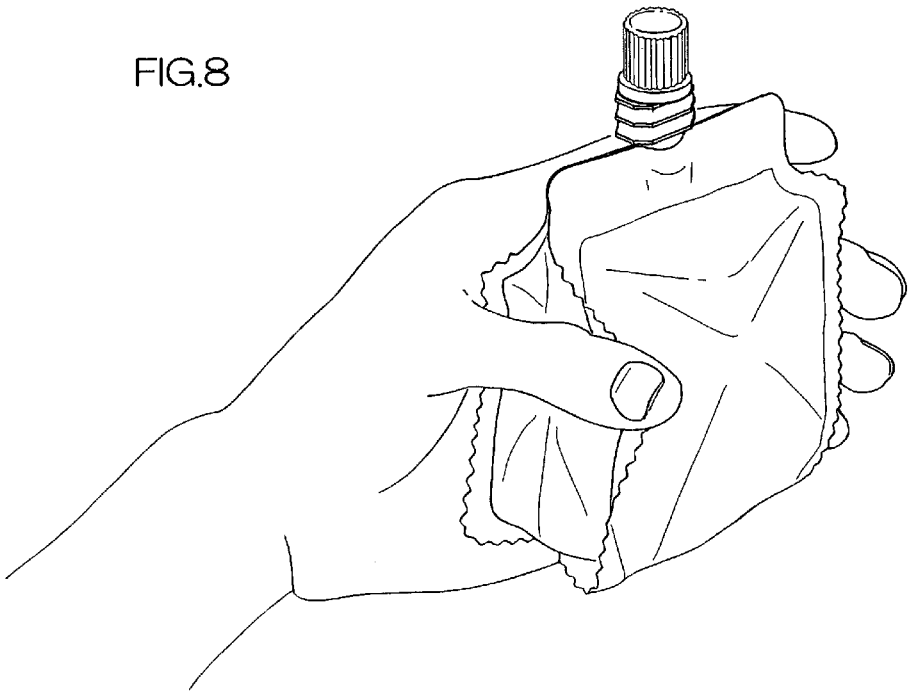
FIG. 8 is an illustration showing the state in which a collapsible container according to the present invention is held by the hand.

As shown in FIG. 1, the collapsible container 1 is provided with a corrugated edge structure 6 in part or in whole at an edge of the joined edge portion 5 thereof. When the corrugated edge structure 6 is formed partially along the edge of the joined edge portion 5, it may be provided at an appropriate location at which the container is held by the hand, as shown in FIG. 8. The corrugated edge structure 6 may be formed along its peripheral edge portion of each of the first and second film members 2 and 3, respectively, prior to joining them, or subsequent to joining them. When it is formed prior to joining, on the one hand, sheets of the laminated film may be cut in a given size and shape with a cutter having a blade pattern corresponding to the corrugated edge structure 6 and the first and second film members 2 and 3 may be bonded together to form a collapsible container. When the corrugated edge structure 6 is formed subsequent to joining, on the other hand, sheets of the laminated film may be bonded together in an appropriate manner and cut in the form of a collapsible container with a cutter having a blade pattern corresponding to the given corrugated edge structure 6.

Figure 2:
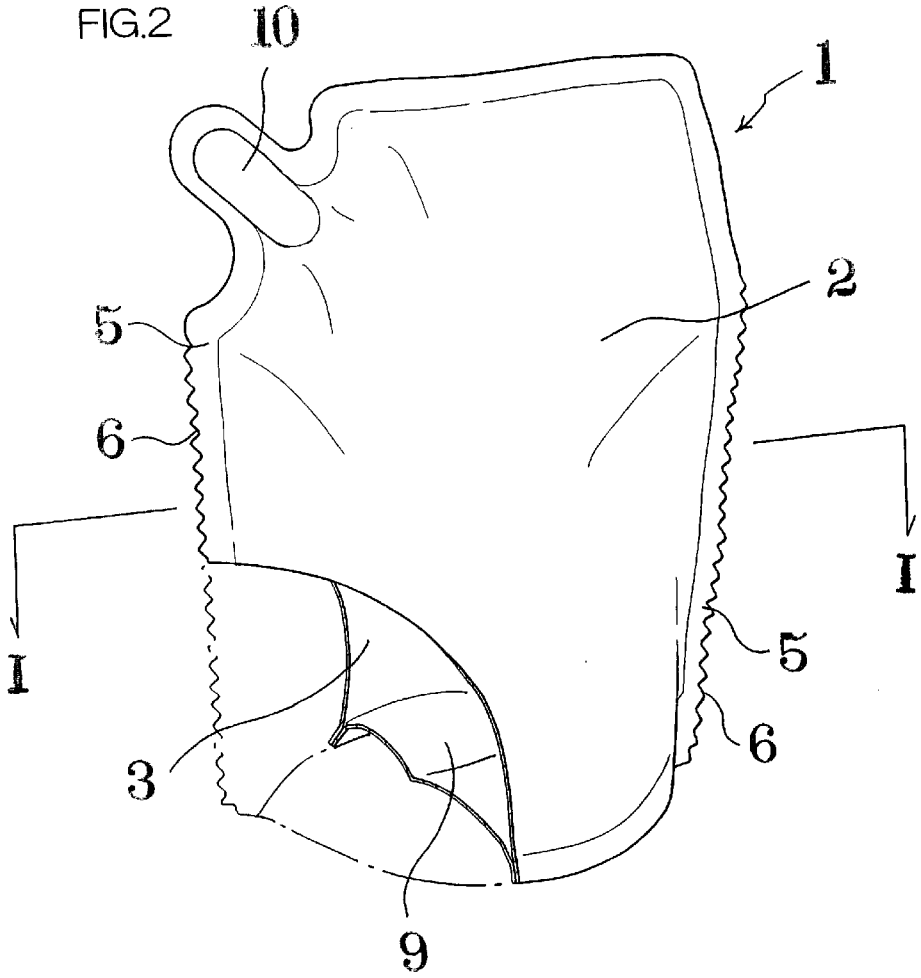
FIG. 2 is a perspective view showing a collapsible container according to a second embodiment of the present invention.

FIG. 2 shows the collapsible container according to the second embodiment of the present invention. As shown in FIG. 2, the collapsible container 1 comprises, for example, the first film member 2 constituting a front face of the container, the second film member 3 constituting a back face thereof, and a bottom film member 9 constituting a bottom of the container. Each of the film members is made of a laminated film having the composition as will be described below in more detail.

The collapsible container is formed such that the first film member 2 and the second film member 3 may be bonded together at the top and side peripheral portions by means of thermal fusion or otherwise, while leaving a portion on top corresponding to an opening 10 and the bottom portions non-joined, and the bottom peripheral portions of the first and second film members 2 and 3 may then be likewise bonded together with the peripheral portion of the bottom film member 9 to form a collapsible container with the opening 10 on top, which can be filled with water or other fluid contents. The side peripheral edge portion 5 of the container at which the side portions of the first and second film members 2 and 3 are bonded together is provided with a corrugated edge structure 6 in part or in whole at the edge thereof.

Then, a description will be made of the collapsible container according to the third embodiment of the present invention with reference to FIGS. 4 and 5. The configuration of the collapsible container according to the third embodiment is substantially equal to that of the collapsible container according to the second embodiment, so that the equal elements are provided with the equal reference numerals and a detailed explanation of the such equal elements will be omitted from the following description in order to avoid duplication.

Figure 4:
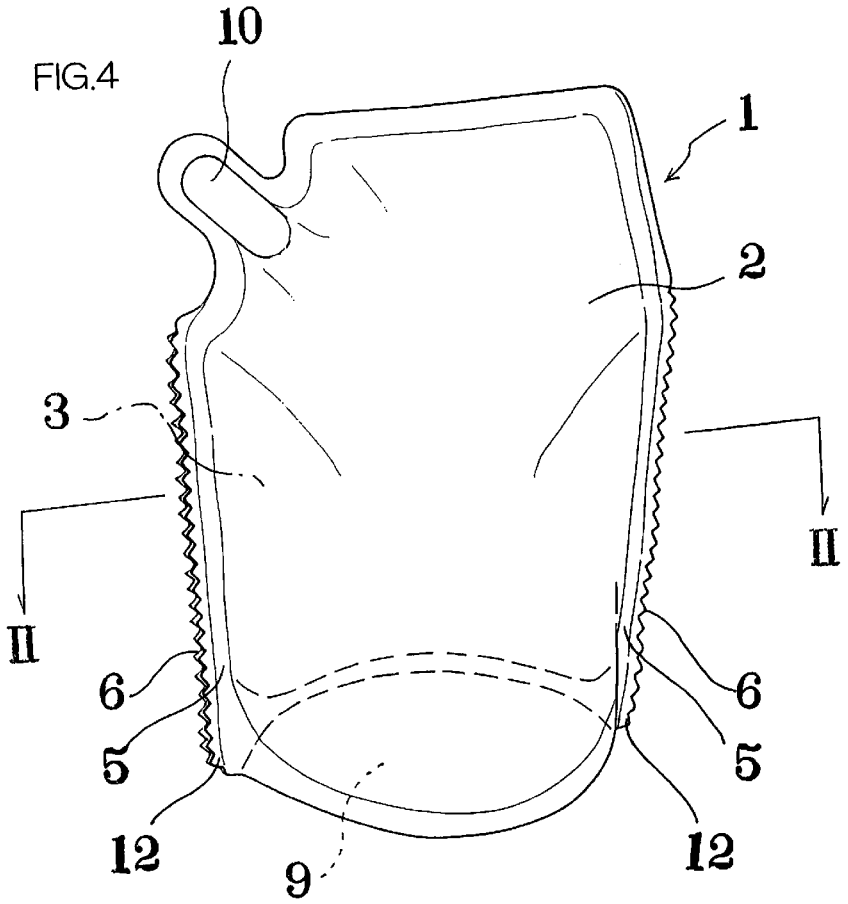
FIG. 4 is a perspective view showing a collapsible container according to a third embodiment of the present invention.
Figure 5:
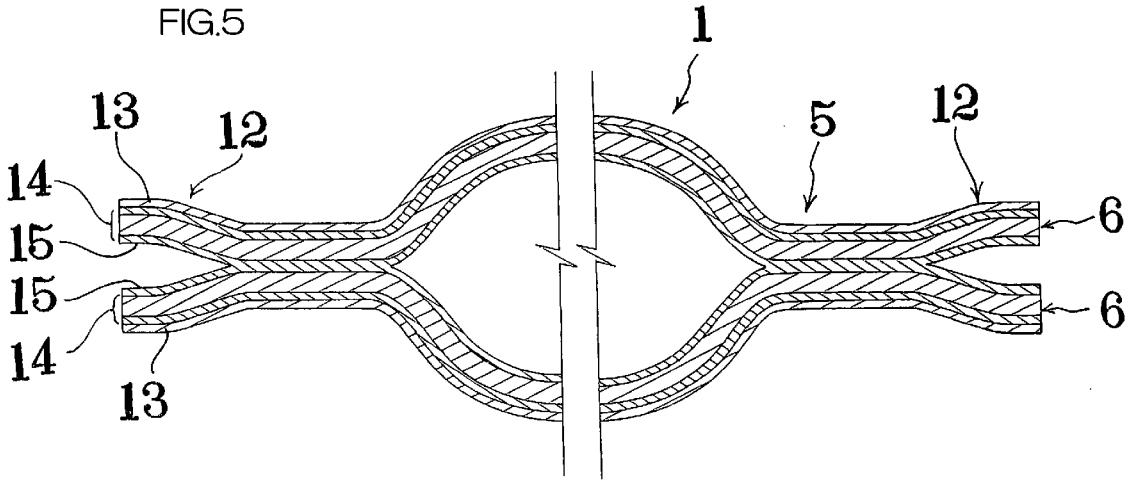
FIG. 5 is a sectional view of the collapsible container of FIG. 4 when taken along line II—II.

As shown in FIGS. 4 and 5, the collapsible container according to the third embodiment of the present invention has substantially the same configuration and action as the collapsible container according to the second embodiment, and the former differs from the latter in that, as specifically shown in FIG. 5, a margin portion 12 that is not bonded together is provided outside the joined peripheral edge portion 5 at which the first and second film members 2 and 3 are bonded together with each other by thermal fusion or any other joining process. It is preferred that the non-joined margin portion 12 is provided with a corrugated edge structure 6 at least in part at and along its edge, although the provision of the corrugated edge structure 6 at the non-joined margin portion 12 is optional as long as the kind of material for the film member does not become so hard to cause the hand holding the container to be cut upon slippage or otherwise. The location of the corrugated edge structure 6 is substantially the same as shown in FIG. 8 in the case of the collapsible container according to the first embodiment. In other words, the corrugated edge structure 6 may be formed at the approximate portion that may be held by the hand, particularly when the corrugated edge structure are formed in part along the joined edge portion 5 or the non-joined margin portion 12.

With the configuration of the collapsible container as described above, the contents may be pushed out or sucked out through the opening by the hand holding the container so that it is preferred to provide the corrugated edge structure at least at such a location at which the hand holds the container. In the case of the collapsible container according to the third embodiment, it may be such that the non-joined margin portion is not so hard depending upon its material or otherwise so that the hand holding the container would not be cut even if the hand would slip along the edge portion. In this case, it is not required that the non-joined margin portion is provided with a corrugated edge structure at the edge thereof.

Figure 6:
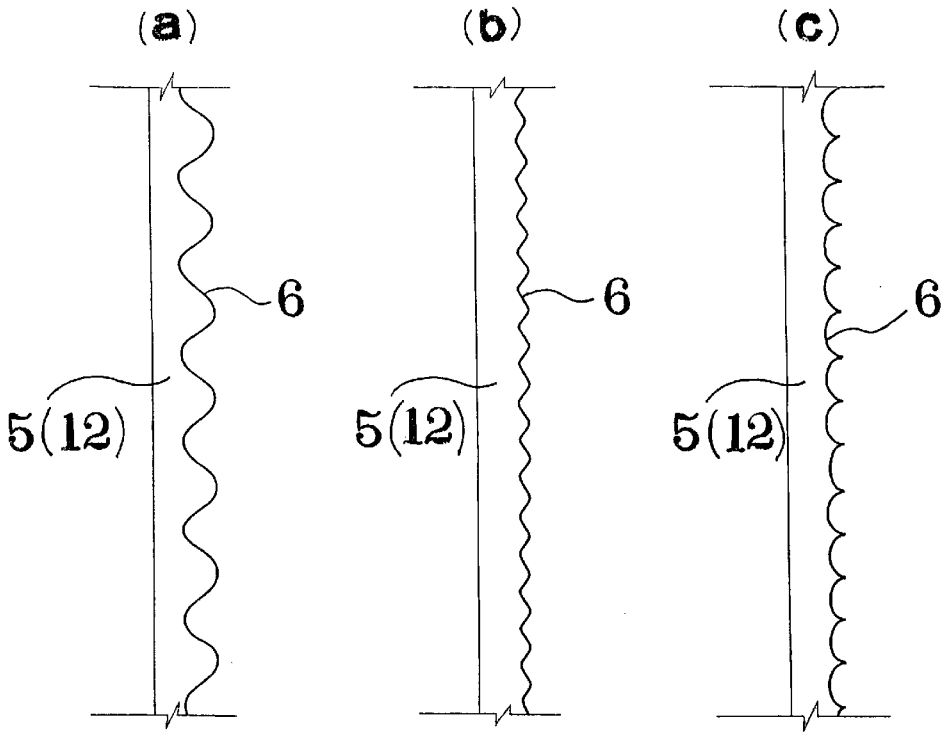
FIG. 6 is a schematic illustration of an edge structure, in which FIG. 6(*a*) shows an edge structure in the form of a wave.

FIG. 6 illustrates a variety of corrugated-shaped edge structures, in which FIG. 6(*a*) indicates a wave-form edge structure; FIG. 6(*b*) indicates a corrugated edge structure in a specific sense; and FIG. 6(*c*) indicates a cycloid-shaped edge structure. As described above, however, the "corrugated" edge structure as referred to in this specification is not understood as being restricted to those specific structures as shown in FIG. 6 and is interpreted as encompassing any and every edge structure that is unlikely to cut the hand holding the container even if the hand would slip along the joined edge portion of the container. The corrugated edge structure may be set to be at an appropriate pitch depending upon the usage, size, etc. of the collapsible container, and if the corrugated edge structure is formed at the pitch of about 2 mm for example, although not limiting to this pitch, it can present the effect of preventing a slippage of the hand holding the collapsible container and it has the shape that can fit the hand readily upon holding the container. Further, the shape of the corrugated edge structure may be used in combination with different types of the shapes of the corrugated edge structure in accordance with the location at which the corrugated edge structure are to be formed.

Moreover, the collapsible container 1 can be folded into two or more when the bottom film member 9 is foldable, so that the empty container can be folded into two or more or rolled as if it were a thin sheet as a whole, and it can be transported readily. Even if the bottom film member 9 would not be foldable, the first and second film members 2 and 3 can be folded around the bottom film member likewise in a thin sheet. When the side film members 4*a* and 4*b* are folded into two or more or rolled, the collapsible container 1 can be folded into two or more or rolled as if it were a thin sheet as a whole, so that it can be carried readily. Even if the side film members 4*a* and 4*b* would not be folded, the collapsible container 1 can also be folded as a whole in the form of a thin sheet because the first and second film members are foldable.

Figure 3:
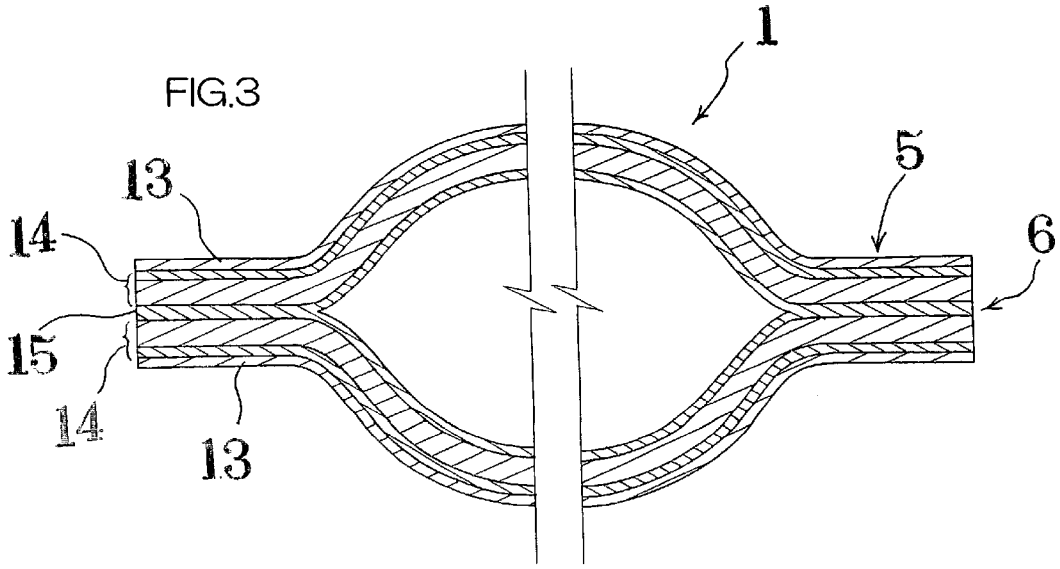
FIG. 3 is a sectional view of the collapsible container of FIG. 2 when taken along line I—I.
Figure 7:
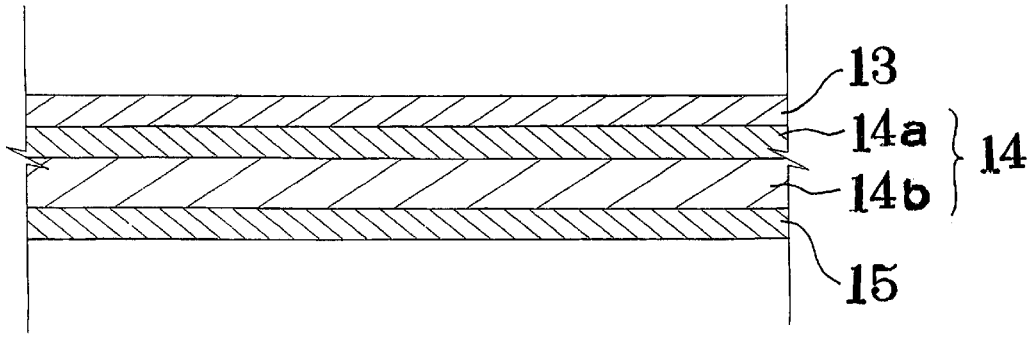
FIG. 7 is a sectional view showing the configuration of a laminated film member.
Figure 9:
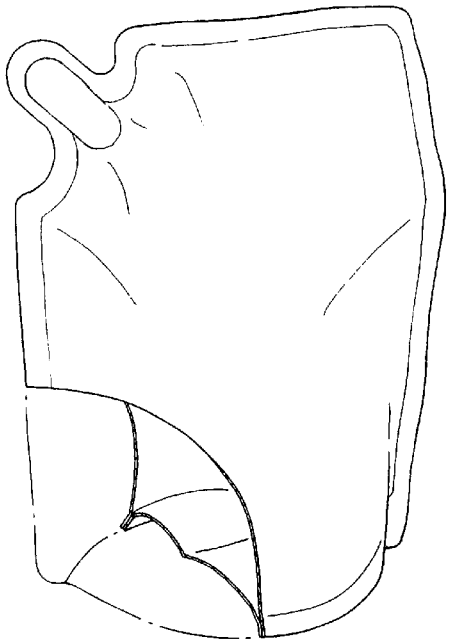
FIG.9 PRIOR ART
FIG. 9 is a perspective view showing an example of a prior art collapsible container.
Figure 10:
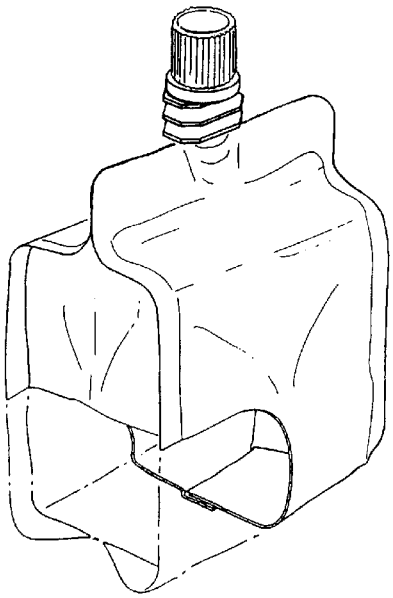
FIG.10 PRIOR ART
FIG. 10 is a perspective view showing another example of a prior art collapsible container.

The laminated film constituting each of the film members for the collapsible container according to the present invention may be composed of plural layers, e.g. three layers, as shown in FIGS. 3, 5 and 7. The three-layer film may comprise the first layer 13, the second layer 14 and the third layer 15. The first layer 13 may be composed of polyethylene terephthalate, oriented nylon or the like. The second layer 14 may be composed of two layers 14*a* and 14*b*, one layer being a composite layer for example with aluminum foil laminated with oriented nylon layer and second layer being aluminum foil, oriented nylon layer, paper or a laminated film of two. The third layer 15 may be made of polypropylene, polyethylene resin, or the like. Moreover, the laminated film may be laminated such that the first layer 13 may be laminated, for example, on the aluminum foil 14*a* of the second layer 14 and the oriented nylon layer 14*b* of the second layer 14 is laminated with the third layer 15. The laminating process is not restricted to a particular one and any laminating process may be applied to the present invention, which may include laminating film layers with adhesive or filming each film layer on the top face of another film layer.

When the composite film is used for the second layer 14, the film member can be provided with a required degree of rigidity by selecting an appropriate kind of material and combining the films with each other.

Although the laminated film having the configuration as described above is preferably used for the collapsible container according to the present invention, any material can also be used therefor as long as such material is used for conventional containers for use with similar purposes.

Further, although the collapsible container according to the present invention is described with reference to the shapes as illustrated in the accompanying drawings, it can be noted herein that the shape of the collapsible container is not restricted to those as illustrated in the accompanying drawings and described above and it encompasses any shape that can fit the objects of the present invention.

A description will now be made of the process for forming the corrugated edge structure at the outer peripheral edge portion of the collapsible container according to the present invention, although the present invention is not limiting to the process as will be described hereinafter.

The corrugated edge structure may be formed by cutting the edge of the outer peripheral edge portion into a shape of the container with a cutter or mold having a blade pattern that fits the shape of the corrugated edge structure of the container. It is to be noted herein that the process of forming the corrugated edge structure, however, is not restricted to the cutting with a cutter or mold and any suitable process can be applied. Moreover, it can be noted that the corrugated edge structure can be formed prior to or subsequent to forming the container. The corrugated edge structure can present the advantages that it can reduce the structural rigidity at the edge of the joined edge portion of the container, so that it prevents the edge of the joined edge portion from being sharp as if a razor blade and consequently that it prevents the hand holding the container from being cut at the sharp edge even if the hand would slip along the joined edge portion of the container.

The collapsible container according to the present invention is described in the above explanation with reference to the first and second film members each having a generally rectangular shape. It is to be noted herein, however, that the shape of the first and second film members is not restricted to the such shape and may include any suitable form that fits the usage of the container and so on as long as the container is provided with the corrugated edge structure at its edge portion as defined above.

EFFECTS OF THE INVENTION

The collapsible container according to the present invention has the advantages that the corrugated edge structure formed at the edge of the container can increase flexibility of the joined edge portion that is cured by thermal fusion or any other appropriate process, so that the risk of injuring the hand holding the container can be reduced.

Further, the collapsible container according to the present invention can prevent the hand holding the container from being cut even if the hand would slip along the joined edge portion of the container because the corrugated edge structure at the edge of the joined edge portion thereof can work as a preventive means for the hand slipping along the edge portion of the container.

Moreover, the collapsible container according to the present invention can be provided with a sufficient level of flexibility and prevent the edge of its joined edge portion from becoming so sharp as a razor blade and the hand holding the container from being cut upon slippage by joining the film members at the joined edge portion together with a margin portion outside the joined edge portion left non-joined. When the corrugated edge structure is further formed at the non-joined margin edge portion of the container, the effects to be achieved by the collapsible container according to the present invention can be gained to a higher extent.

What is claimed is:

1. A collapsible container, comprising:

sheets of laminated film joined together with one another at outer peripheral regions thereof to collectively define an enclosing structure for receiving a dispensable fluid material which is bounded by an outer peripheral portion;

said sheets of laminated film defining a margin portion outside the outer peripheral portion at which said sheets of laminated film are joined together, said sheets of laminated films remaining unbonded in said margin portion; and outer edges of portions of said sheets of laminated film defining the margin portion being provided at least in part with a corrugated edge structure.

2. The collapsible container according to claim 1, wherein:

said sheets of laminated film include at least a first film member and a second film member, said second film member having a size substantially equal to the first film member; and said first film member and said second film member are joined together at outer peripheral regions thereof thereby defining said outer peripheral portion where mutually joined and said margin portion outward thereof.

3. The collapsible container according to claim 2, wherein said corrugated edge structure is formed at the edge of the outer peripheral regions of said first film member and said second film member prior to joining said first film member and said second film member.

4. The collapsible container according to claim 2, wherein said first film member comprises a laminated film composed of at least two sheets of film and said second film member comprises a laminated film composed of at least two sheets of film.

5. The collapsible container according to claim 4, wherein:

said laminated film comprises three layers including a first layer comprising one of a polyethylene terephthalate layer and an oriented nylon layer, a second layer comprising one of aluminum foil, oriented nylon, paper and a composite layer of two, and a third layer comprising one of a polyethylene resin layer and a polypropylene resin layer;

said first layer is laminated on a face of said second layer and a remaining face of said second layer is laminated on said third layer; and said collapsible container is formed with the third layer of each of at least two sheets of said laminated film joined together.

6. The collapsible container according to claim 1, wherein at least one of said sheets of laminated film is provided with a corrugated edge structure at the edge of an outer peripheral region thereof prior to joining the sheets of laminated film.

* * * * *